United States Patent [19]

Kar

[11] Patent Number: 4,708,752

[45] Date of Patent: Nov. 24, 1987

[54] PROCESS FOR LASER HARDENING DRILLING BIT CONES HAVING HARD CUTTER INSERTS PLACED THEREIN

[75] Inventor: Nareshchandra J. Kar, Westminster, Calif.

[73] Assignee: Smith International, Inc., Newport Beach, Calif.

[21] Appl. No.: 843,048

[22] Filed: Mar. 24, 1986

[51] Int. Cl.[4] ..... C21D 1/09; C21D 9/22

[52] U.S. Cl. ..... 148/127; 148/152; 148/903

[58] Field of Search ..... 148/152, 127, 4, 39, 148/13, 903, 901, 905; 277/9

[56] References Cited

U.S. PATENT DOCUMENTS 3,680,873 8/1972 Garner ..... 277/9
4,303,137 12/1981 Fischer ..... 148/39

FOREIGN PATENT DOCUMENTS 0007251 1/1982 Japan ..... 148/152

*Primary Examiner*—L. Dewayne Rutledge
*Assistant Examiner*—S. Kastler
*Attorney, Agent, or Firm*—Robert G. Upton

[57] ABSTRACT

A medium to high carbon steel body of a roller cone for a drilling bit is machined to final dimensions, and is thereafter rendered absorbent to laser light by application of black paint or black etch. Holes for hard tungsten carbide or like inserts are drilled in the light absorbent steel body. The entire steel body, including the holes, is subjected to a laser treatment which, however, is effective to raise to above austenitizing temperature only the dark light absorbent surfaces. Walls of the insert holes, being shiny, reflect the laser light and are not effected by it. Rapid self-quenching of the laser heated surfaces results in a hard martensitic layer in the external surface, with a surface hardness of 57 to 60 Rockwell C units. The seal gland, heel, and spindle bore areas of the roller cones are hardened similarly by exposure to laser light. In an alternative process, the hard tungsten carbide or like inserts are press fitted into the holes before the laser treatment. The subsequent laser treatment does not affect the inserts adversely, because the inserts, too, have shiny light reflective surfaces, and therefore do not absorb the laser light.

4 Claims, 12 Drawing Figures

PROCESS FOR LASER HARDENING DRILLING BIT CONES HAVING HARD CUTTER INSERTS PLACED THEREIN

BACKGROUND OF THE INVENTION

1. Field of the Invention

The present invention is directed to a process of manufacturing cones of drilling bits which have hard cutter inserts. More particularly, the present invention is directed to a process of laser hardening the outer shell and certain other surfaces of roller cone bits of the type which also have hard tungsten carbide or like cutter inserts.

2. Brief Description of the Prior Art

One important type of rotary drill bit used for subterranean drilling includes cutter cones which have hard tungsten carbide or like cutter inserts. Usually such cutter cones are rotatably mounted on journal legs of the drill bit so as to rotate as the drill bit is rotated. The drill bit may be rotated from the surface, or by a "downhole" motor. The tungsten carbide or like hard cutter inserts of cutter cones are pressed into insert holes formed in the external surface of the cutter cones. These tungsten carbide inserts bear against the rock formation at the bottom of the hole, crushing and chipping the rock as drilling proceeds.

Because rock drilling is a technically very demanding service, and because failure of a drilling bit can cause very costly interruption in the drilling process, the construction of rock bits must be very rugged. Usually the cones of the drilling bit are made of forged alloy steel, although powder metallurgy and related cones have also been described in the patent and technical literature. Bearing surfaces are located within the interior of the cones to enable rotatable mounting to the journal leg. An effective seal must be provided between the rotating cone and the journal leg so as to prevent escape of lubricating grease from the bearings, and to prevent entry of drilling fluid and other foreign matter in the bearing.

The steel body of the cone itself must be sufficiently ductile and tough so as to avoid fracture or shattering. Certain parts of the interior of the cone, particularly the ball bearing races, must be quite hard in order to provide sufficiently long bearing life. The exterior of the cutter cone ideally should also be quite hard and abrasion resistant so as to avoid rapid wear due to its exposure to the formation, and the highly abrasive and erosive action of the drilling fluid.

The tungsten carbide or other hard inserts in the roller cones must be held sufficiently strongly so as to prevent premature loss. The inserts must also be prevented from rotating in the insert holes, because rotation in the insert hole leads to decreased drilling efficiency and eventually to loss of the insert.

In view of the economic importance of subterranean drilling for oil and other minerals, the prior art has developed a variety of technological approaches to more or less satisfy the above-summarized requirements.

In accordance with one basic approach, the forged steel cone body is made of a "carburizable" low carbon steel, which, however, has sufficient ductility and toughness to be adequately resistant to fracture. Certain parts of the interior of the cone, such as the bearing races, may be carburized to increase their hardness, leaving the exterior of the cone without a hardened case.

Alternatively, the bearing races and the exterior shell of the cone may both be carburized. However, this alternative procedure has not been employed widely, because it is difficult to drill insert holes into the exterior shell through a hardened carburized case. Moreover, the obvious alternative of first drilling the insert holes, and thereafter carburizing the exterior shell, is also impractical because the interior of insert holes should not be carburized. This is because a hardened case in the insert holes would render the wall of the insert holes less ductile and less fracture resistant, and therefore would make press fitting of the hard inserts into the holes impractical or very difficult. Carburizing also tends to distort drilled holes.

In final analysis, carburizing rotary drilling bit cones is relatively labor consuming, because stop-off paint must be applied to the cone in several areas where hardening by carburization is not desired. Application of stop-off paint becomes particularly laborious, if carburization of the external shell is desired, because in this case the insert holes must be drilled first, and the stop-off paint must be applied to the insert holes as well. Moreover, little can be done to eliminate hole distortion from this high temperature heat treatment. In accordance with some prior art procedures, the exterior of the cone shell is carburized, but the carburized exterior case is removed in a finish machining operation before the insert holes are drilled.

In light of the foregoing difficulties, most roller cones have an exterior shell surface which is not carburized, and have a surface hardness of only approximately 42 Rockwell C (Rc) hardness units. Whereas the alloy steel of these cones is adequately ductile and tough, lack of external shell surface hardness and abrasion resistance results in relatively rapid wear and erosion of the cone shell during drilling, often resulting in loss of tungsten carbide inserts and inadequate bit performance.

Another alternative., described in U.S. Pat. No. 4,303,137, is to selectively heat treat and rapidly quench an interior surface layer of the ball bearing races of the roller cones, so as to form a hard martensitic layer and a hard bearing surface therein. This selective heat treatment may be accomplished by bombardment of the bearing races with a laser beam, as is described in U.S Pat. No. 4,303,137.

As is apparent from the foregoing, there is still a substantial need in the prior art for a process for substantially hardening, in an economically feasible manner, the exterior shell surface and other surfaces of hard insert bearing roller cones. The present invention provides such a process.

SUMMARY OF THE INVENTION

It is an object of the present invention to provide an economical process for hardening the exterior shell surface of hard insert bearing cones for drilling bits.

It is another object of the present invention to provide an economical process for hardening the seal gland and certain other surfaces of hard insert bearing cones for drilling bits.

It is still another object to provide an economical process for hardening the exterior shell surface of hard insert bearing cones for drilling bits, in a manner which does not substantially interfere with the sequence of operations for placing the hard inserts into the cone.

The foregoing and other objects and advantages are attained by a process where a cone blank is formed substantially to finished dimensions from medium to high carbon hardenable steel. The cone includes an exterior shell surface. A coating is applied at least to the exterior shell surface to render it dark and absorbent to laser light. A plurality of insert holes are thereafter formed in the exterior shell surface to accept, through a conventional press fitting, a plurality of hard tungsten carbide or like cutter inserts. The exterior shell surface is thereafter bombarded by a laser light of sufficient intensity and for sufficient time to elevate the temperature of a surface layer in the shell to above austenitizing temperature. Thereafter, the surface layer is rapidly quenched to form a hard martensitic layer. The insert holes have shiny, metallic, light reflective surfaces which are substantially unaffected by the bombarding laser light, so that formation of the martensitic layer occurs only on the exterior shell.

In an alternative process of the present invention, the tungsten carbide or like hard cutter inserts are press fitted into the insert holes. The exterior shell, having the dark laser light absorbent coating and the shiny cutter inserts, is bombarded by laser light so as to create austenite and thereafter martensite in the exterior surface of the shell. The shiny, light reflective inserts are, in this process too, substantially unaffected by the laser light.

In addition to heat treating and thereby hardening the exterior surface of the shell, laser light is also employed, in accordance with the present invention, to heat treat the seal gland and heel surfaces of roller cones for rock bits.

The features of the present invention can be best understood, together with further objects and advantages, by reference to the following description, taken in connection with the accompanying drawings.

DESCRIPTION OF THE SPECIFIC EMBODIMENTS

Figure 1:
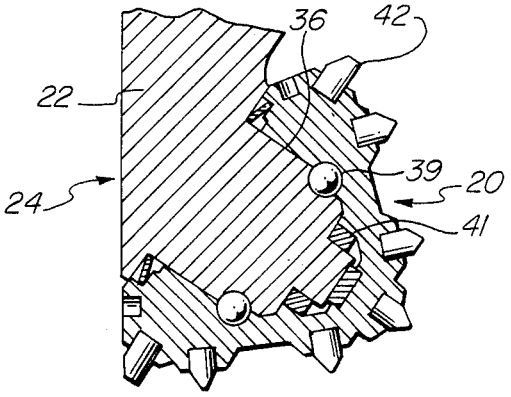
FIG. 1 PRIOR ART
FIG. 1 is a cross-sectional view of a prior art roller cone of a rock bit mounted on a journal leg.

The following specification taken in conjunction with the drawings sets forth the preferred embodiments of the present invention. The embodiment of the invention disclosed herein are the best mode contemplated by the inventor for carrying out his invention in a commercial environment, although it should be understood that several modifications can be accomplished within the scope of the present invention.

Referring now to the drawing Figures, the process of the present invention for the manufacture of a roller cone 20 of a rock drilling bit is illustrated. Nevertheless, it should be understood that the process of the present invention may be used for the manufacture of other types of drilling bits, and other tools as well, and is therefore not limited to roller cones.

Figure 2:
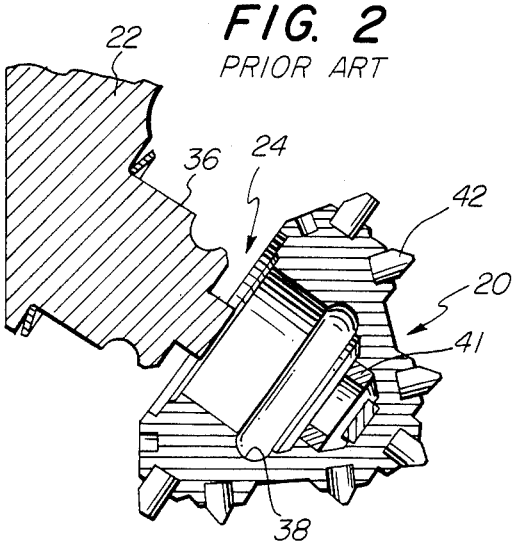
FIG. 2 PRIOR ART
FIG. 2 is an exploded cross-sectional view of the prior art roller cone and journal leg shown in FIG. 1.
Figure 3:
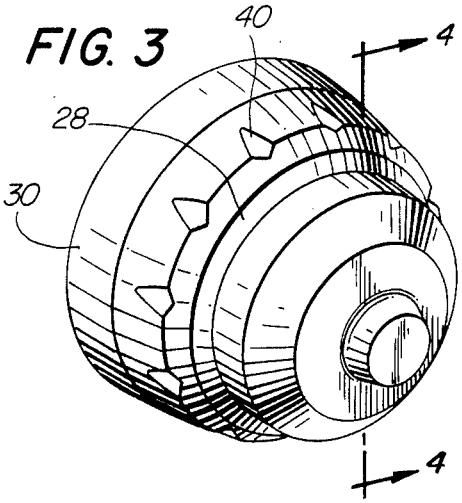
FIG. 3 is a perspective view of a roller cone blank, being an intermediate in the process of the present invention.
Figure 4:
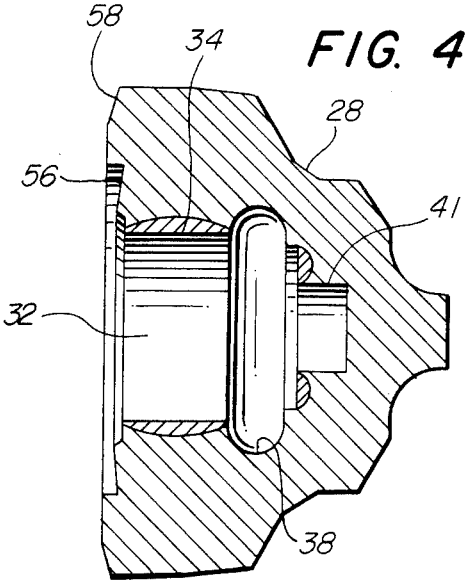
FIG. 4 is a cross-sectional view of the roller cone blank shown in FIG. 3, the cross-section being taken on lines 4,4 of FIG. 3.
Figure 5:
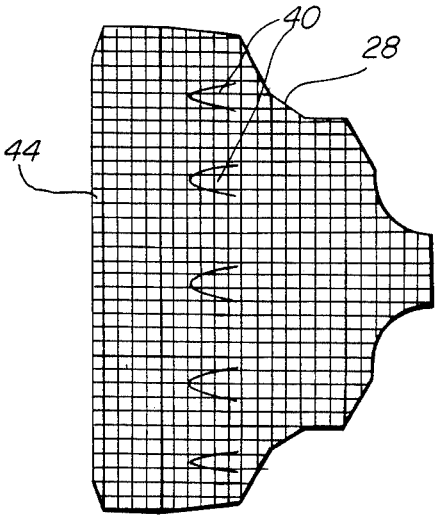
FIG. 5 is a side view of the roller cone blank after a step in the process of the present invention, wherein a black paint or etch has been applied to the surface of the blank.

FIGS. 1 and 2 illustrate prior art roller cones mounted to the journal leg 22 of a rock drilling bit 24. As it will become apparent from the ensuing description in connection with FIGS. 3 through 11, in the hereindescribed preferred embodiments the process of the invention is applied to a roller cone 20 of substantially conventional overall configuration. Therefore, the mechanical features and configuration of the roller cone 20 and of the associated journal leg 24 are not described here in detail. Rather, for a detailed description of these conventional features, reference is made to U.S. Pat. Nos. 4,303,137 and 3,680,873, the specifications of which are hereby expressly incorporated by reference.

Although there is a similarity in overall appearance between the prior art roller cone illustrated in FIGS. 1 and 2, and the roller cones 20 made in accordance with the present invention, in the novel process of the invention, the roller cone 20 attains a hard case on its exterior shell 28 and in certain other portions of its surface. The hard exterior case and the other surfaces are very beneficial for the durability and reliability of operation of the drilling bit 26.

Thus, in accordance with the present invention, a forged steel body 30 of the roller cone 20 is machined to substantially close final dimensions. The forged steel body 30 includes an interior cavity 32 having a bearing race 34 lined, in accordance with practice in the art, with a "soft" aluminum bronze alloy. The bearing race 34 contacts a complementary race 36 of the journal leg 24. The race 36 of the journal leg 24 is shown on FIGS. 1 and 2. The interior cavity 32 also includes a ball race 38 for the balls 39 which retain the roller cone 20 on the journal leg 22. The balls 39 are shown on FIG. 1. The ball race 38 may be hardened by a laser hardening process described in U.S. Pat. No. 4,303,137. The spindle bore 41 may also be similarly hardened in accordance with the present invention.

The exterior shell 28 of the steel body 30 of the roller cone 20 contains a plurality of spaced notches or flow channels 40. The flow channels 40 serve to facilitate flow of the drilling fluid (not shown) to the tungsten carbide or like hard cutter inserts 42 which are incorporated in the roller cone 20. The cutter inserts 42 are shown on FIGS. 1 and 2 in connection with the prior art, and also on FIG. 10 in connection with another embodiment of the process of the present invention.

The steel body 30 of the roller cone 20 comprises, in accordance with the present invention, medium or high carbon steel, which can be readily hardened by heating to above austenitizing temperature, followed by rapid cooling. A preferred alloy steel for the steel body 30 of the roller cone 20 is known under the AISI designation 4340, although such other alloy steels as AISI 4140, 4330, and 4130 are also suitable. Generally speaking, for the practice of the present invention, the body 30 of the roller 20 can be made from the steels described in U.S. Pat. No. 4,303,137 (incorporated herein by reference). It will be readily understood by those skilled in the art that AISI 4340 steel, preferred for the practice of the present invention, contains approximately 0.40% carbon. The surface hardness of this steel body 30, without the further treatment described in the ensuing specification, is approximately 40–42 Rockwell C (Rc) hardness units.

In accordance with the present invention, a black paint or black etching liquid (not shown) is applied to the forged and machined steel body 30 of the roller cone 20, so as to obtain a darkened intermediate steel body 44. The black paint or black etch (not shown) may be of the type commonly known and used in the art, and need not be described here in detail. The intermediate steel body 44 bearing the light absorbing black paint or black etch is shown on FIG. 5.

In the next step of the process, a plurality of insert holes 46 are drilled on the exterior shell 28. Drilling of insert holes 46, per se, is known in the art. More particularly, the insert holes are usually drilled to be approximately 0.003 inch smaller in diameter than the hard cutter inserts 42 are to be press fitted into the holes 46. Typically, a force of approximately 500 pounds may be required to press the cutter inserts 42 into place in the insert holes 46. A problem which has been substantially unsolved in the prior art in connection with the insert holes 46 is that drilling of the holes 46 through a hardened, carburized (or hardfaced) exterior shell is difficult. On the other hand, walls of the insert holes 46 must not be carburized or otherwise hardened. This is because, as it was pointed out in the introductory section of the present patent application, hardening of the walls 48 of the insert holes 46 makes placement of the inserts 42 into the holes 46 very difficult, and creates a danger of cracking of the steel body 30 of the cone 20.

Figure 6:
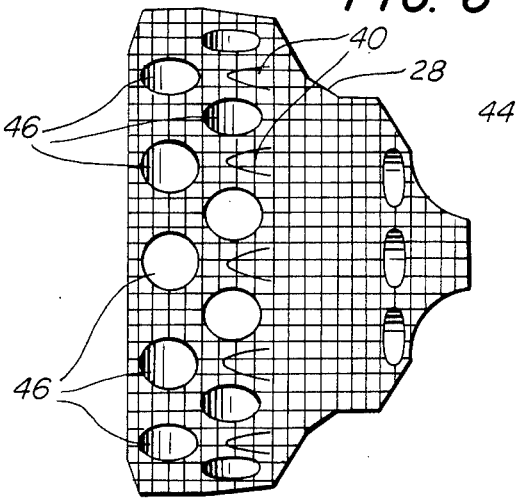
FIG. 6 is a side view of the roller cone blank after another step in the process of the present invention, wherein holes for holding hard tungsten carbide or like inserts, have been drilled in the blank.

Referring now specifically to FIG. 6, after the step of drilling of the insert holes 46, the intermediate steel body 44 has a black, light absorbent exterior shell 28, but the walls 48 of the insert holes 46 are shiny and light reflective.

Figure 7:
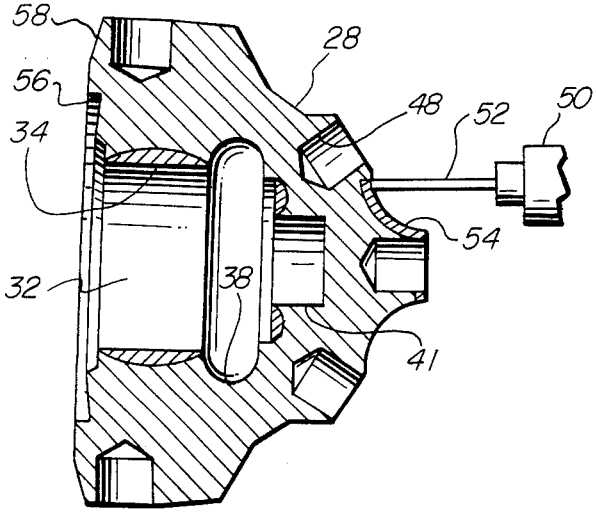
FIG. 7 is a cross-sectional view of the roller cone blank, schematically showing a stage in a step in the process of the present invention where the exterior shell of the cone is bombarded by laser light.
Figure 8:
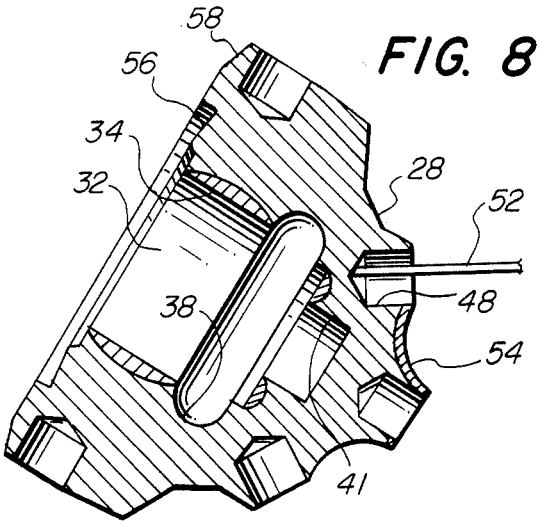
FIG. 8 is a cross-sectional view of the roller cone blank, schematically showing another stage in a step in the process of the present invention where the exterior shell of the cone is bombarded by laser light.

Referring now to FIGS. 7 and 8, the next step in the process of the present invention is shown schematically. In this step the intermediate steel body 44 of FIG. 6 is bombarded by a laser beam 52 of sufficient intensity to rapidly heat a surface layer of the exterior shell 28 to above austenitizing temperature (approximately 800° C.). More specifically, FIG. 7 schematically illustrates a source 50 of the laser beam 52. The laser beam 52 used in the process of the present invention must be powerful enough for the herein-described application; a continuous wave carbon dioxide laser of at least approximately 1500 watts power output is suitable. In the herein-described preferred embodiment of the process of the present invention, a carbon dioxide laser generator, Model 975 of Spectra Physics Company, San Jose, Calif., is used. The laser beam 52 used in this preferred process has 2000 watt power, and a beam diameter of approximately 0.4".

In accordance with the invention, the entire exterior shell 28 of the intermediate steel body 44 is treated with the laser beam 52, in a raster pattern by using a mechanical scanner (not shown). Alternatively, an optical integrating mirror arrangement (not shown) can also be used to cover the surface of the exterior shell 28 with the laser beam 52. The purpose of the scanner or optical integrator would be to widen the coverage of the laser beam.

As it will be readily understood by those skilled in the art, the laser beam 52 rapidly heats a surface layer in the exterior shell 28 to above austenitizing temperature, that is, to approximately 800° C., or higher. Moreover, as the laser beam 52 is removed from contact with a localized area, the area is very rapidly cooled by sinking its heat into the surrounding large, cool steel body 44. As a result, "scanning" with the laser beam 52 serves as a very effective means for creating a hard martensitic layer 54 in the exterior shell 28. The hard martensitic layer 54 is schematically shown on FIGS. 7–10, indicating the procession of the process in which the martensitic surface layer 54 is formed.

Figure 9:
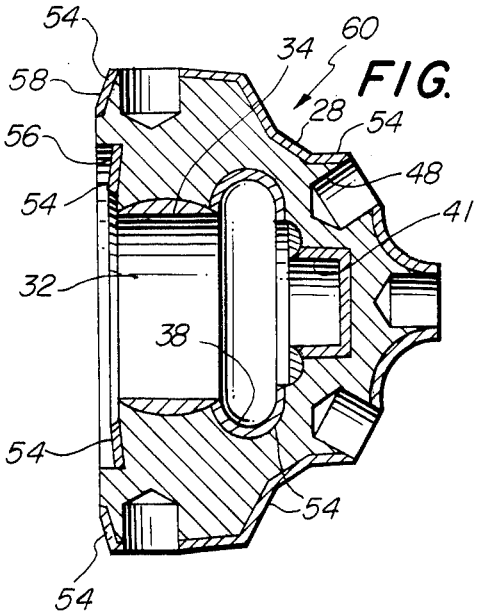
FIG. 9 is a cross-sectional view showing the roller cone blank after the step of bombarding with laser light has been completed on the cone shell surfaces.
Figure 10:
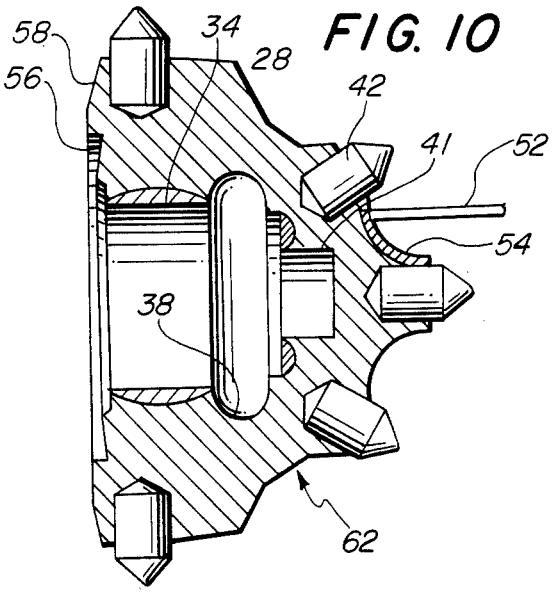
FIG. 10 is a cross-sectional view of a roller cone having inserted hard cutter inserts, the roller cone being subjected to bombardment by laser light in accordance with another embodiment of the process of the present invention.

Referring now particularly to FIGS. 8 through 10, a principal novel feature of the present invention lies in the fact that the treatment with the laser beam 52 of the exterior shell 28 need not be selective to exclude the insert holes 46. This renders the step of laser treating the exterior 28 of the cone 20 economically feasible. FIG. 8 illustrates the phase in the laser treatment step wherein the laser beam 52 impacts into the bottom wall 48 of an insert hole 46. Walls 48 of the insert holes 46, however, are light reflective, and therefore do not absorb laser light, or absorb it only to a minimal extent, so that the walls 48 of the holes 46 are not heated above austenitizing temperature in the process.

Moreover, the laser beam 52 is focused in relation to the exterior surface 28. Therefore, the beam 52 hitting the walls 48 of the holes 46 is essentially out of focus, and this further contributes to its ineffectiveness to austenitize an exterior layer of the walls 48.

As a further feature of the present invention, the seal gland area 56 and heel area 58 are also laser treated. These areas are best shown on FIGS. 9 and 11. FIG. 9 indicates, with conspicuous cross-hatching, all areas of the steel body of the roller cone 20, which have attained the hard martensitic layer 54 as a result of the laser treatment followed by rapid self-quenching of the invention. The intermediate steel body of the roller cone 20, shown on FIGS. 9 and 11, bears the reference numeral 60. Cutter inserts 42 may be inserted into the insert holes 46 of the steel body 60 to yield the final roller cone 20. Because the walls 48 of the holes 46 have not been hardened in the laser treatment, their ductility is not adversely affected, and the process of inserting the cutter inserts 42 may be performed in a substantially conventional manner.

It will be readily appreciated by those skilled in the art that the intensity of the laser beam 52 and the duration of its impact on the intermediate steel body 44 of the roller cone 20 may be adjusted to obtain a martensitic layer 54 of virtually any desired practical thickness. Preferably, the martensitic layer 54 is between approximately 0.06 to 0.12" thick, most preferred is a martensitic layer 54 of approximately 0.060 to 0.070" thickness. A martensitic layer 54 of approximately 0.04" is considered to be adequate in connection with the process of the present invention when it is applied to roller cones. The hardness of the surface layer 54 achieved in accordance with the present invention is approximately 57 to 60 Rockwell C (Rc) units. This is in contrast with the approximately 40 to 42 Rc hardness of the 4340 AISI steel utilized for the steel body 30 of the cone 20, and with the approximately 52–55 Rc hardness of carburized steel surfaces of some prior art roller cones. As it will be readily understood, the actual surface hardness of the roller cones attained in the process of the present invention, is also dependent on the type of steel used for the forged steel body 30.

The hardness of the martensitic layer or case 54 attained on the surface of the exterior shell 28, and in the seal gland 56 and heel areas 58, is substantially uniform with respect to depth. In this regard, the martensitic layer 54 is superior to a carburized case, the hardness of which gradually diminishes with case depth.

FIG. 10 schematically illustrates another embodiment of the process of the present invention. In this embodiment, insert holes 46 are drilled into the black painted or black etched steel body 44 of the roller cone 20. Thereafter, the hard cutter inserts 42 are inserted into the holes 46 in a conventional manner. The hard cutter inserts 42 preferably comprise tungsten carbide, although the present invention is not limited by the nature of the inserts 42

The intermediate roller cone, bearing the reference numeral 62, is then subjected to laser treatment in the manner described above in connection with the first preferred embodiment. The laser beam 52 does not sufficiently raise the temperature of the inserts 42 to cause damage, because the inserts 42 are shiny and reflective to laser light. The laser beam 52 is also out of focus with respect to the inserts 42, and this also contributes to the lack of effectiveness of the laser beam 52 on the inserts 42.

Figure 11:
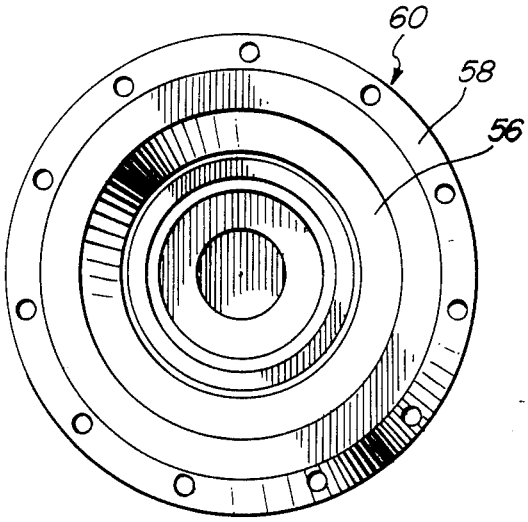
FIG. 11 is a plan view of the bearing cavity containing side of the roller cone shown in FIG. 9.

FIG. 11 illustrates the cavity containing side of the roller cone 20 after the process steps of the present invention have been performed. The seal gland 56 and heel 58 areas, which have been hardened by laser treatment, are shaded on FIG. 11.

Figure 12:
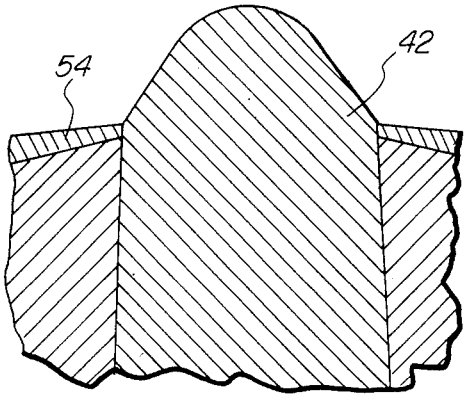
FIG. 12 is a schematic drawing representing a cross-section micrograph of an actual roller cone prepared in accordance with the process of the present invention, the micrograph representing an approximately six-fold magnification.

Significant advantages of the roller cones 20 prepared by the process of the present invention include the greatly increased hardness and dramatically improved abrasion and erosion resistance of the exterior shell. This, of course, results in dramatically less "wash out" of the cone shell, and prolonged life. Also, the finished cone has inserts surrounded by a high yield strength cone shell, as indicated on FIG. 12. This retards any tendency for inserts to rock or rotate during drilling. Moreover, increased hardness of the seal gland 56 results in less abrasion in that very important area of the drilling bit also, and less "comet tail wear", which is normally caused by debris (not shown) caught between the sealing surfaces. Moreover, the laser treatment is relatively low in energy requirements, and can be performed within a short period of time, for example, in 3.5 minutes. Still further, laser treatment does not affect the dimensions of the roller cone, so that little or no finish machining is required after the laser treatment. The medium to high carbon steel which is used in conjunction with the process of the present invention is also less expensive than the carburizable low carbon steel which is necessary for making a roller cone having a carburized, hard exterior shell. In light of the foregoing factors, the overall cost of laser treatment and of the roller cones attained thereby is low.

Several modifications of the process of the present invention may become readily apparent to those skilled in the art in light of the present disclosure. Therefore, the scope of the present invention should be interpreted solely from the following claims, as the claims are read in light of the disclosure.

What is claimed is:

1. A process for forming a tool having a hard cutter insert, the process comprising the steps of:

forming a tool blank from a medium to high carbon hardenable steel, the tool blank having an external surface;

applying a coating to the external surface to render the external surface dark and absorbent to laser light;

after the step of applying the coating, forming at least one hole for the hard cutter insert, and affixing the hard cutter insert into the hole, the hard cutter insert having shiny light reflecting external surfaces, to provide a first intermediate tool blank, the first intermediate tool blank thereby including dark light absorbent surfaces and also reflective surfaces relatively unabsorbent to laser light;

after the step of affixing the hard cutter insert into the hole, bombarding the external surface of the first intermediate tool blank with a laser beam that is principally focused on the external surface of the first intermediate tool blank, the laser beam being of sufficient intensity and operated for sufficient time so as to austenitize an external layer in the light absorbent external surface of the first intermediate tool blank, the external surface of the hard cutter insert being out of focus when exposed to the laser beam; and cooling the austenitized layer sufficiently rapidly to form martensite in the external layer of the light absorbent external surface, whereby the tool is obtained having a hardened external case.

2. The process of claim 1 wherein the step of cooling comprises cooling by self-quenching.

3. The process of claim 1 wherein before the step of bombarding with a laser beam, the tool blank has a surface hardness of approximately 40 to 42 Rc hardness units.

4. The process of claim 1 wherein after the steps of bombarding and cooling, the surface hardness of the tool is approximately 57 to 60 Rockwell C hardness units.

* * * * *